United States Patent [19]

Stouffer

[11] Patent Number: 4,565,220

[45] Date of Patent: Jan. 21, 1986

[54] LIQUID METERING AND FLUIDIC TRANSDUCER FOR ELECTRONIC COMPUTERS

[75] Inventor: Ronald D. Stouffer, Silver Spring, Md.

[73] Assignee: Bowles Fluidics Corporation, Columbia, Md.

[21] Appl. No.: 470,791

[22] Filed: Feb. 28, 1983

[51] Int. Cl.[4] ..... F15C 01/04

[52] U.S. Cl. ..... 137/835; 123/480; 137/38; 137/825; 137/833; 364/431.05; 364/509

[58] Field of Search ..... 364/509, 510, 431.07, 364/431.05; 137/38, 825, 833, 835, 839; 123/480; 235/200 PF, 201 PF

[56] References Cited

U.S. PATENT DOCUMENTS

| | | | |
|---|---|---|---|
| Re. 30,870 | 2/1982 | Inoue | 137/831 X |
| 3,182,686 | 5/1965 | Zilberfarb | 137/831 X |
| 3,247,861 | 4/1966 | Bauer | 137/835 X |
| 3,266,511 | 8/1966 | Turick | 137/831 X |
| 3,275,016 | 9/1966 | Wood | 137/835 |
| 3,545,466 | 12/1970 | Bowles | 137/839 X |
| 3,550,604 | 12/1970 | Richards et al. | 137/833 X |
| 3,576,182 | 4/1971 | Howland | 123/444 |
| 3,703,633 | 11/1972 | Hanada et al. | 235/200 PF |
| 3,878,376 | 4/1975 | Sholes, Jr. et al. | 364/509 |
| 4,000,757 | 1/1977 | Freeman | 137/835 X |
| 4,037,598 | 7/1977 | Georgi | 364/510 X |
| 4,052,002 | 10/1977 | Stouffer et al. | 137/835 X |
| 4,387,429 | 6/1983 | Yamauchi et al. | 123/480 X |
| 4,438,496 | 3/1983 | Ohie | 364/431.07 X |

OTHER PUBLICATIONS

"The Thinking Man's Guide to Car Maintenance" by Bob Cerullo on Throttle-body fuel injection: Popular Science, Nov. 1982, pp. 86–88.

*Primary Examiner*—Errol A. Krass
*Assistant Examiner*—Edward R. Cosimano
*Attorney, Agent, or Firm*—Jim Zegeer

[57] ABSTRACT

The invention relates to fluidic transducers of electrical signals from an electronic computer for accurately metering flow of a liquid to a utilization device. A liquid filled hollow channel means is accelerated along the flow axis thereof to produce a fluid control signal for a bistable fluidic switch element having a pressurized, cross-over type interaction region leading to a common outlet and to a pair of output passageways. In a preferred embodiment, electrical signals from an electronic computer are supplied to a coil centered by a spring in a magnetic field, first in one direction of current flow and then in the opposite direction, to introduce bidirectional movement of the coil and the hollow channel means coupled thereto. The signals are preferably frequency modulated (but may be pulse width modulated).

16 Claims, 9 Drawing Figures

FIG. 7a
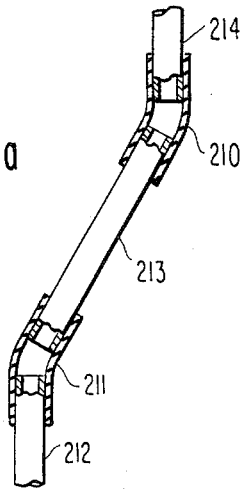
FIG. 7b
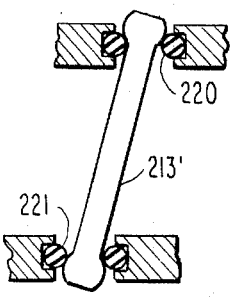
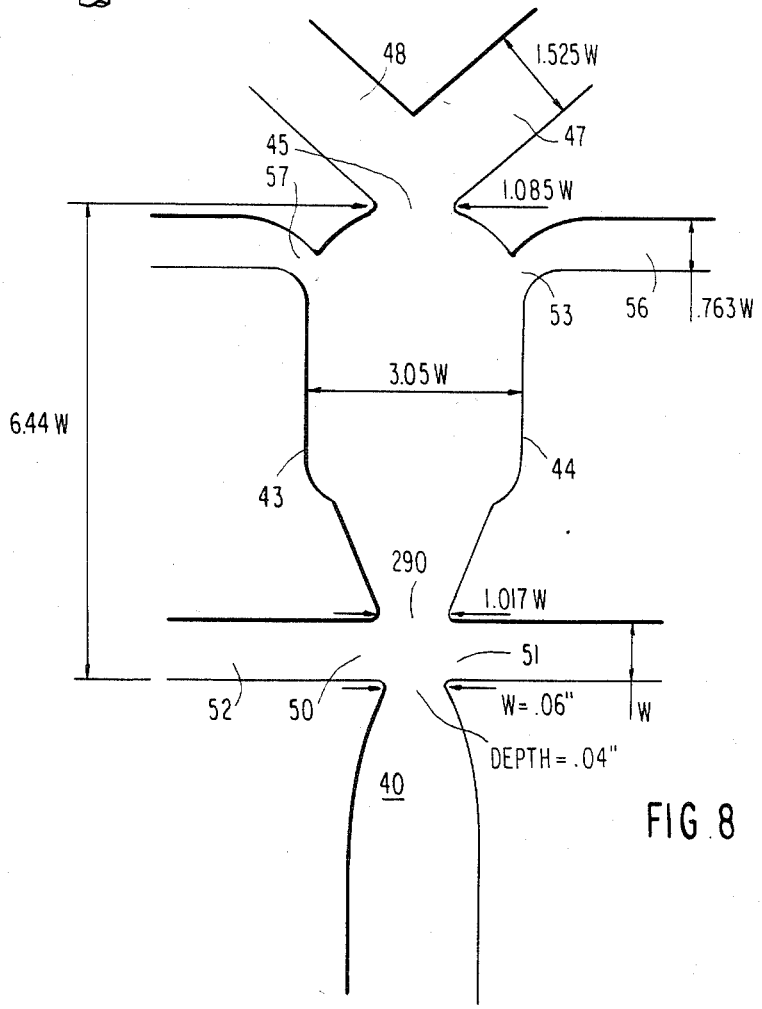
FIG. 8

LIQUID METERING AND FLUIDIC TRANSDUCER FOR ELECTRONIC COMPUTERS

BACKGROUND AND BRIEF DESCRIPTION OF THE INVENTION

There are many instances wherein electronic computers and more recently microprocessors are used to assimilate information from sensors, stored data, etc. and compute an accurate quantity of liquid flow for the most efficient and/or proper operation of a system or process using such liquids. For example, in fuel management systems for internal combustion engines of an automobile, currently on-board computers are supplied with data from sensors monitoring various engine operating parameters such as speed, temperature, exhaust gas characteristics, etc. and determine the proper fuel-air ratio for fuel economy and efficiency, smoothness of engine operations and compliance with emission standards. The electrical control signals are applied to a solenoid controlled fuel injection valve, which typically is biased closed by a spring so that a large electrical current is required to open the valve. As another example, in chemical manufacturing processes, computers are used to analyze process conditions (temperature, pressure, flow rates, output product parameters, etc.) and produce control signals that require precise and accurate metering of a liquid constituent. Solenoid controlled mechanical valves, which have relatively slow responses, are used to control the flow of liquid constituents in the process.

In these examples it is clear that while modern electronic computers and microprocessors have been developed to provide highly accurate control signals for controlling liquid flow, the control devices per se have typically been a solenoid controlled mechanical valve. These solenoid type valves and fuel injectors have difficulty in accurately tracking electrical signals and delivering short liquid pulses mainly because of their large pintel mass, which is magnified in the case of springs biasing them closed. The leading edge, in particular, of the liquid pulse delivered to the utilization system is not sharp. In the case of solenoid controlled fuel injectors for internal combustion engines, the output nozzles, are very sensitive to fluid loading so that if a passageway to direct the output fuel pulse to specific port intake targets (such as the valve stem) were attached, the performance is severely degraded.

The basic objective of this invention is to provide an improved liquid metering device and method. Another objective of the invention is to provide a fluidic transducer controlled by an electronic computer. Another objective of the invention is to provide an improved bistable fluidic liquid metering device. A further objective of the invention is to provide a hybrid bistable fluidic liquid flow metering device which is controlled by signals from an electronic computer. Another objective of the invention is to provide a transducer for translating an electronic control signal to a fluid control signal.

According to the invention, a hollow channel member, filled with liquid, is coupled to a member which receives acceleration (and deceleration) movements, there being at least a component of such movements along the axis of said hollow channel member. The control signal-pressure wave created by this movement of the liquid along the axis thereof travels at 4000–5000 ft./sec. A bistable fluidic switching element coupled to receive the control signal permits the full switching capability of the device to be utilized. The movement of the hollow channel member is produced by an electronic computer which produces electrical control signals that are applied, in push-pull fashion to a coil in a magnetic field. In the preferred embodiment, the coil is coupled to the hollow channel member and the liquid therein, very much like a voice coil in the magnetic field of loud speaker. The bistable fluidic switch element has an interaction region-chamber of the type wherein the sidewalls converge to a common outlet, which outlet feeds liquid flowing therethrough to first and second output channels, one leading to the utilization device and one leading to the supply of liquid. The common outlet with the converging sidewalls isolates the interaction region-chamber from the output channels and the converging sidewalls generates feedback vortices for maintaining the liquid flowing in the channels on one of the sidewalls until switched by the fluidic signal. In this embodiment, there are a pair of control ports upstream at each side of the entrance of the liquid jet into the interaction region-chamber. The opposie ends of the hollow channel or tube members are coupled to the chamber downstream of the control ports. In the preferred embodiment, both hollow channel or tube members are moved simultaneously under the action of the magnetic forces. They are connected to their respective control ports and downstream couplings to the chamber such that when the coil is accelerated in one direction, the liquid flow is switched to one side of the interaction region-chamber and through the common outlet to a selected one of the output passageways and when the coil is accelerated in the opposite direction, the liquid flow is switched by the control signal-pressure wave to the opposite side of the interaction region-chamber and to the other output passageway. Thus, the fluid circuit is constructed to maintain continuous flow through the passages to clear any vapor or air. The liquid is not required to cool the magnetic elements (as in a solenoid controlled fuel injector, for example). Since the control signal-pressure wave is generated by movement of a relatively short segment of liquid filled channel members, the motive force required of the magnetic system is much smaller and the fluidic bistable switch responds rapidly and more accurately to the electronic signals thereby much more effectively utilizing the speed and accuracy of current electronic computers. Since the response is faster than solenoid controlled valve systems, the liquid flow pulses can be frequency modulated or pulse (liquid pulse) width modulated to achieve highly accurate metering. The signals from the computer can modulate the flow of liquid between the output passageways at any rate desired. Moreover, since the bistable fluid switch elements can be molded, the cost is less as compared to solenoid controlled valve elements which may require careful machining of valve seats and pintles, etc., relatively heavy coils and currents. Finally, the reliability of liquid metering devices made according to the present invention is improved since the only moving parts are the coil and hollow channel or tube members.

BRIEF DESCRIPTION OF THE DRAWINGS

The above and other objects, advantages and features of the invention will become more apparent when considered in light of the following specification and accompanying drawings wherein:

FIGS. 7*a* and 7*b* illustrate the flexible fluid couplings for the device shown in FIGS. 1 and 5; and FIG. 8 is a scaled silhouette of a bistable switch element incorporated in the invention.

FIG. 1, which is a diagrammatic illustration of one form of the bistable fluidic switch 12, has a power nozzle 40 coupled to receive liquid, such as fuel from a fuel pump for an internal combustion engine, on supply line 29 and issues a jet 41 into interaction region chamber 42 (shown in FIG. 8) which has sidewalls 43, 44 which first diverge and then converge to a common outlet 45 such that upon switching states the jet 41 crosses over from the side 43, for example, to issue through the common outlet 45 into an outlet channel or passageway 47 on the opposite side which, as indicated in FIG. 1, is coupled to a full return line (not shown) for returning fuel to the tank (not shown). When the power jet 41 has been switched to the opposite side 44, the power stream 41 is on the opposite side to that illustrated e.g. right side 44 and exits through common outlet opening 45 to output passage or channel 48 which is then supplied to a utilization means such as an internal combustion engine. Switching element 12 is bistable such that it is in one stable state or the other, that is, the fluid in the power jet 41 will exit and return to the tank via output passageway 47 unless some control signal is applied to cause it to switch to the opposite state. Thus, in the embodiment illustrated in FIG. 1, a pair of control ports 50, 51 are provided adjacent the power nozzle input 40 with the control port 50 being coupled by passageway 52 to an opening 53 in the interaction region-chamber 42 downstream of the control ports 50, 51 and, in the like manner, control port 51 is coupled by a fluid passageway 56 to an opening 57 on the opposite side of the interaction region and downstream of control ports 50 and 51. In this embodiment, pressure pulses are simultaneously generated by the fluid in passages 52 and 56 to exert opposite control signals, respectively, to cause the power jet 41 to switch positions and, accordingly, the fluidic switch to switch states.

The transducing of the electronic signals from the computer 20 to a fluidic pulse signal is illustrated in FIG. 2. The basic objective is to create a differential control pressure in the fluidic element at or very near the power nozzle 40 where the effect of pressure differential is greatest. In this embodiment, control passages 52, 56 are used to convert the electronic signals to a fluid differential control pressure at the control ports 50, 51. Accordingly, as is illustrated in FIG. 2, an accelerating force or movement is applied to the hollow channel 66 portion of channel 52 being shown in FIG. 2 and the liquid therein. In FIG. 2, the channel 52 is illustrated in a U-shaped flexible tubing arrangement having a portion 66 which is moved in the directions indicated in the dotted lines to create a differential pressure at the ends 60, 61 in cover plate 62 which coupled the ends 60, 61 to passageways 63, 64 which lead to control port 50 and opening 53 in the bistable fluidic switch 12. As diagrammatically illustrated, the computer 20, which in this preferred embodiment is conventional, may be the on-board computer for an automobile internal combustion engine, generates a signal in control line 21-1 which is applied to a magnetic or (piezoelectric) element 31 to generate a force which is applied along the flow axis of tubes 66, 66′ in a direction indicated by double arrow 65 to all or a portion 66 of tube 52. It will be appreciated that the tube 52 may have many different configurations and may simply be rigid tubes, adapted for movement in the direction of the flow axis thereof.

The amplitude of the pressure wave generated is directly proportional to the acceleration (g-forces) and the length of the tube (e.g. column of liquid) along the axis of motion.

Figure 1:
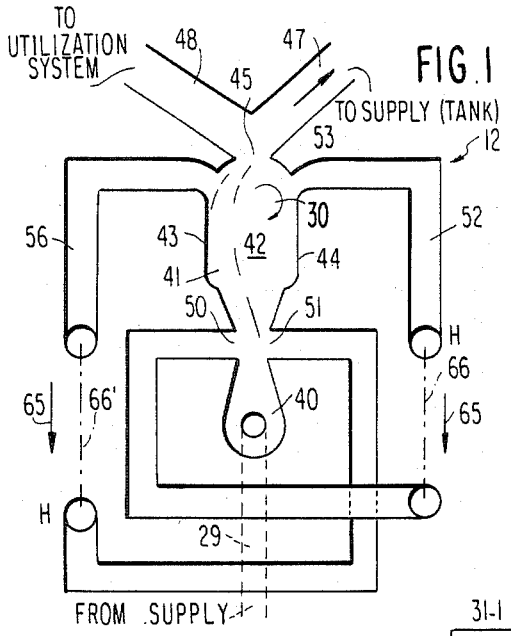
FIG. 1 is a schematic diagram of a computer controlled liquid metering fluidic switch element according to the invention.
Figure 4:
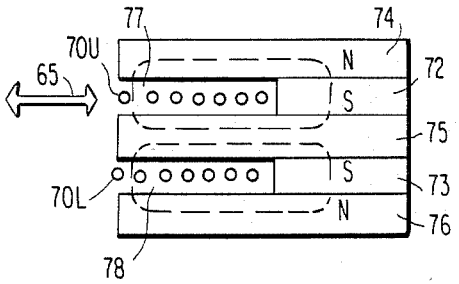
FIG. 4 is a partial sectional view demonstrating the action of the permanent magnetic fields on the coil illustrated in FIG. 3.

The pressure is transient in nature because it is generated by the inertial response of the liquid in tube portions 66 as this tube is accelerated by the applied force as indicated by the double arrow 65. Thus, when the acceleration ceases, the pressure differential likewise disappears. The generated pressure differential is thus directional so that the opposite polarity is obtained when the tube is forced in the opposite direction. This method therefore requires no rubbing, wearing, or moving parts and no seals are required (e.g. no dynamic seals). Thus, when the liqiud jet 41 is on the left side 43 so that liquid from power nozzle 40 is being returned to the tank or other supply (not shown) or to a further utilization device (not shown) via, output passage or channel 47, a differential pressure pulse is generated in both fluid passages 52 and 56. As illustrated in FIG. 1, the moving portions 66 and 66′ of tubes 52 and 56, respectively, have been accelerated (as indicated by the double arrows) to create the high pressure at the points marked H. The fluidic element is shown switched to the low pressure side. When the acceleration is ended, the normal feedback of the element shown will lock the jet to the side that it has been switched to thereby making the element a bistable flip-flop rather than an oscillator. This normal feedback comprises, in part, the vortex 30 and, in part, a portion of the power stream fluid which is fed back through the tube 56 as a positive feedback. It will be appreciated that in some fluidic elements only one such feedback may be used to achieve this bistable property.

When pressure pulse is induced in the two tubes in the opposite direction, the liquid jet 41 is again switched to the opposite side. Thus, the current through coil 70 is bidirectional in that it flows first in one direction for one switching action and then the opposite direction for the opposite switching action of the bistable switch. Thus, the output electrical circuit in computer 20 may be a push-pull amplifier connected to ends 80 of coil 70.

Because the magnetic element in this invention does not require a large current, the switching is extremely rapid and imposes very little loading on the electronic computer or any drive circuit for applying force to the fluid in passages 52 and 56. Thus, the magnetic elements can be in the form of a voice coil driver or, alternatively, instead of a magnetic driver, the driver can be in the form of piezoelectric element which translates the electronic signal from the on-board computer 20 to a force for switching the power stream from power nozzle 40 from one side to the other of interaction region 42. Liquid switching rates of several hundred Hz can be achieved with the invention with the leading edges of the liquid pulses through the output passage 48 to the utilization device being much sharper as compared to solenoid operated valves and thereby achieving a much more accurate metering of liquid flow to the utilization device.

Figure 3:
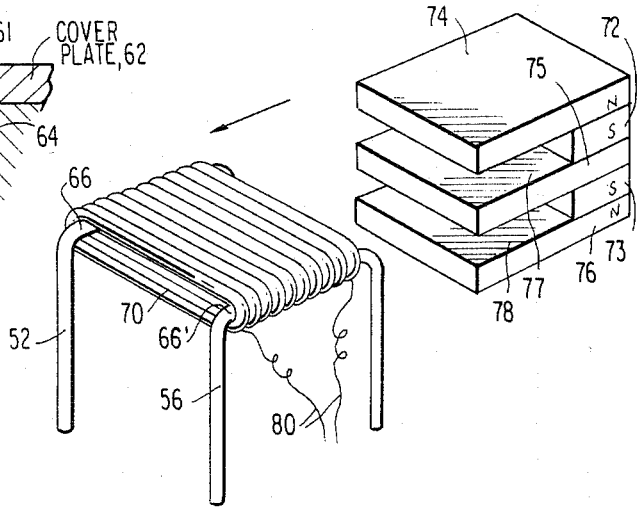
FIG. 3 is a partial isometric view of the transducer for converting the electronic control signals from the computer to fluidic control signals.

In FIG. 3, the fluid is accelerated by a coil 70, similar to the voice coil of a speaker, which is secured to tube portion 66 for channel or passageway 52 and tube portion 66' for channel 56. Coil 70 moves back and forth within a magnetic structure 71, similar to the magnetic structure of a speaker, which is composed of permanent magnets 72 and 73 which are joined by three pole pieces 74, 75 and 76 with air gaps 77 and 78 in which the upper 70U and lower 70L runs of coil 70 move. In this embodiment, the portions of tubes 52, 56 coupling portions 66 to the bistable switch are resilient springs and support coil 70 in the air gap. The movement illustrated in FIG. 3 is exaggerated and the air gap is made sufficient to accomodate coil 70 at each extreme of its movement. Current for exciting coil 70 is supplied via lead wires 80 from the output of computer 20. It will be appreciated that as close magnetic coupling as can be achieved is desired without contact between the moving parts.

In some systems, such as internal combustion engines, there may be positive pressure pulses in the runners due to overlap of the exhaust and intake valves, which occurs almost coincidental with the controlling peak vacuum in the intake runner of the cylinder before the firing order. In order to isolate the interaction region of the distributor from such conditions at the load, the preferred embodiment of the invention incorporates a bistable fluidic switch having a cross-over type output region wherein the power stream entirely fills the outlet to thereby prevent the outlet pressure (e.g., pressure in the runners), from affecting the interaction region.

Thus, as shown in FIG. 8, the interaction region is of the cross-over type and serves to isolate the interaction region from pressures downstream of the throat or outlet as disclosed in Bowles U.S. Pat. No. 3,545,466, owned by the assignee hereof. It will be appreciated that the nozzle at the point of injection of fuel into an internal combustion engine may be an oscillating nozzle for uniform droplet formation, such as is disclosed in my U.S. Pat. No. 4,151,955. Moreover, the fluidic element may preferably be mounted so that undelivered fuel is caused to drain to the interaction region by gravity.

Figure 5:
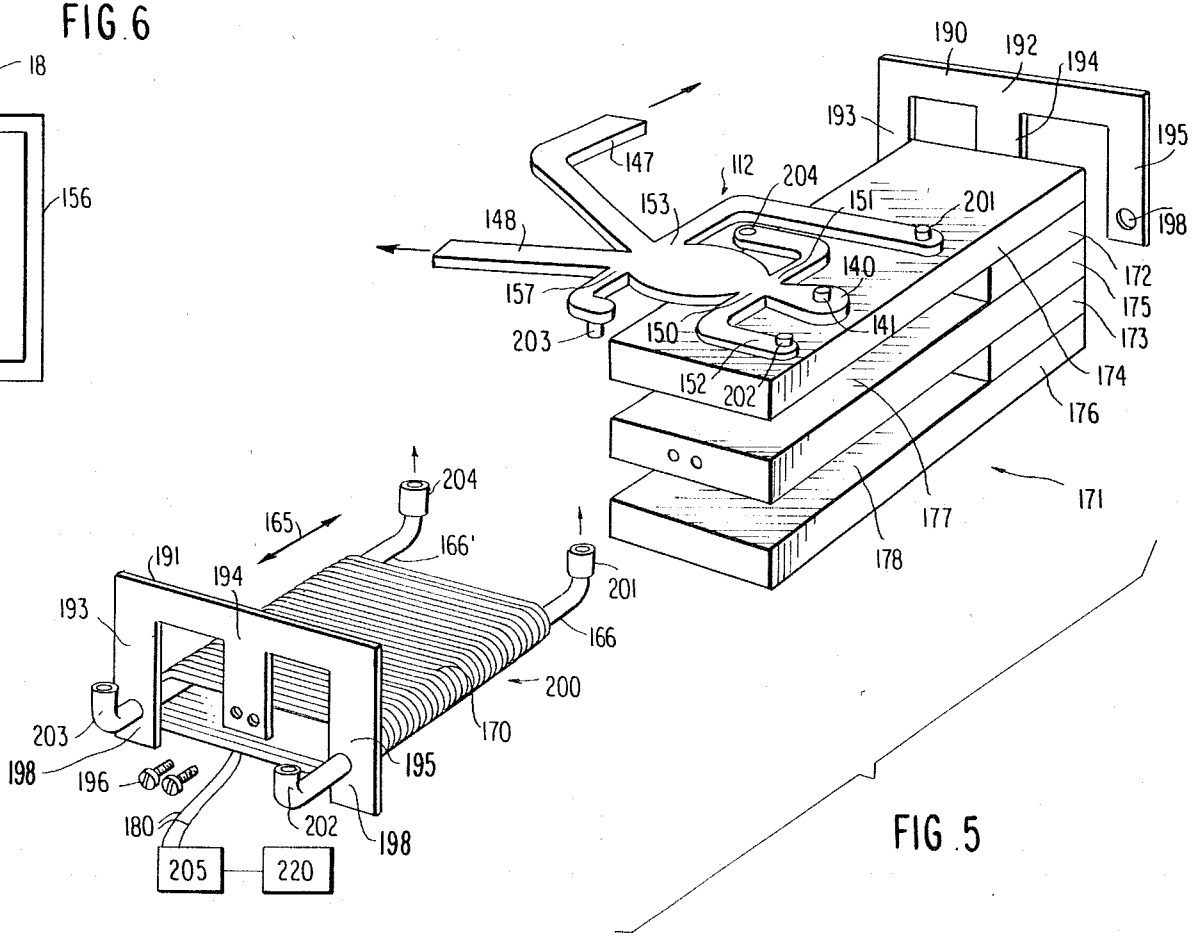
FIG. 5 is an exploded isometrical view of a further embodiment of the invention showing centering springs which provide substantially linear movement in the magnetic field.

In the embodiment shown in FIG. 5, bistable fluidic switching element 112 is mounted on magnetic structure 174 and the coil-tube portion of transducer platform 200 has the of tube portions 166 and 166' transverse to the axis of fluidic element 112. The platform 200, coil 170 and tubes 166, 166' are supported by a pair of E-shaped springs 190 and 191 to minimize coil movement transverse to the axis parallel to axis 165. Springs 190 and 191 are identical and include a horizontal connecting portion 192, which is free to move, and three depending legs 193, 194 and 195. Depending center leg 194 is secured at its lower end by fastener means 196 to the center plate 175 of the magnetic structure 171. The ends of tubes 166 and 166' are carried in apertures 198 in the lower ends of spring legs 193 and 195, respectively. Thus, movement of the upper and lower conductor runs of coil 170 and air gaps 177 and 178, respectively, is along a path maintained substantially straight and linear by these flexible springs 190 and 191. The ends of tubes 166 and 166' are coupled by tubing 201, 202, 203 and 204 to bistable fluidic element 112.

As indicated by the double-headed arrow 165, platform 200 is driven in one direction and then the other by a push-pull amplifier circuit 205 controlled by, in this embodiment, the on-board computer 220. It will be appreciated that the signals to the push-pull amplifier can modulate the frequency of switching (frequency modulation or FM) or the time duration of the switched states (pulse width modulation or PWM). In both forms of modulation, the bistable fluidic switch is in one stable state or the other, FM controlling the rate of switching, and PWM controlling the time duration of the respective switched states.

Figure 2:
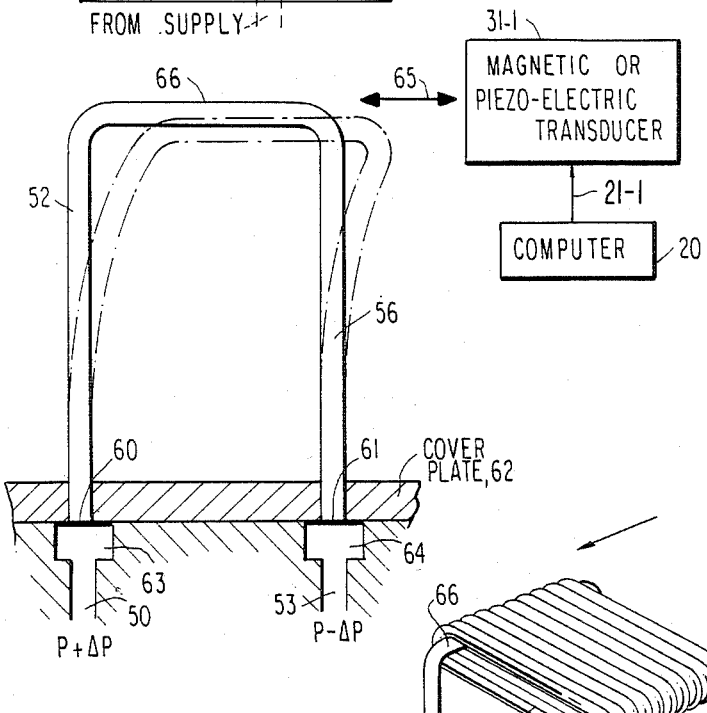
FIG. 2 is a partial schematic view of the electronic signal to the fluidic signal transducer according to the present invention.
Figure 6:
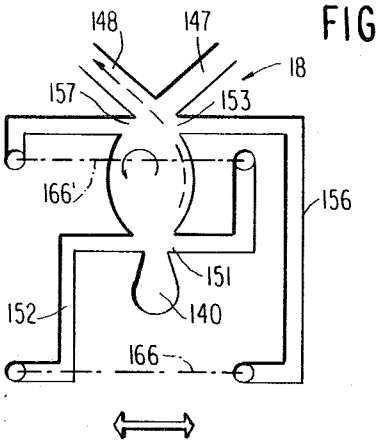
FIG. 6 is a schematic circuit diagram of the fluidic bistable fluid switch shown in FIG. 5.

In FIG. 6, a schematic diagram of the fluidic switching element is illustrated and it operates essentially as described above in connection with FIG. 2.

Instead of springs 190 and 191, the ends of tubes 166, 166' on platform 200 can be coupled to the bistable fluidic switch 112 by rigid tubes with flexible coupling joints as shown in FIGS. *7a* and *7b*. In FIG. *7a*, the coupling utilizes elastomer elbows 210, 211. In this embodiment, tube 212 corresponds to one of the ends of tubes 166 or one of the ends of tube 166', tube 213 is a rigid coupling tube and tube 214 can correspond to one of the ends of tube 152 or 156, for the connections to tube 166 and the same for the other side of the unit. In FIG. *7b*, the flexible coupling utilizes O-rings 220, 221 for coupling the ends of rigid rube 213' to the ends of the tubes 166, 166' and the control inputs to bistable fluidic switch 112. In preferred embodiments of the invention, non expansible or rigid tubes, channels or passageways are used to minimize loss in energy in the pressure pulses due to expansion of the walls of the passageways, channels or tubes when non-rigid elements are used. It will be appreciated that there are many other ways of coupling control passages of the bistable fluidic switch to the ends of the moving tube. The length of the tube is not particularly critical to operation of the unit. Units have been operated with tubing lengths of several feet and tubing lengths of no greater than the distance of between the moving platform 200 and the fluidic switch shown herein.

FIG. 8 is a scale drawing showing a preferred form of the bistable fluidic switch element. In FIG. 8, the proportionate dimensions which are given are all in the relation to the width W of the power nozzle 240. Thus, the common outlet opening 245 has a width of 1.085 W and each output passageway 247, 248 have a width of 1.525 W. The width of the chamber 242 is 3.05 W and the distance from nozzle 40 to common outlet 45 is about 6.44 W. Each control port 50, 51 is about 1 W and each opening 53, 57 is about 0.763 W. The point 290 where sidewalls 43, 44 begin to diverge is about 1.017 W. In this embodiment, the diverging portions of walls 43, 44 are straight and, in addition the chamber includes a pair of substantially parallel sidewalls connecting the diverging portions to the converging portions via openings 53, 57.

It is clear that the objects of the invention are achieved in a relatively simple and inexpensive manner resulting in an overall improvement in accurate metering of liquids to utilization devices.

While there has been disclosed preferred embodiments of the invention, it is intended that various modifications, adaptations and improvements thereon incorporating the spirit of the invention be included within the scope of the claims appended hereto.

What is claimed is:

1. In a liquid metering apparatus for a utilization system having computer means for producing electrical control signals for controlling the liquid flow to said utilization system, the improvement comprising, bistable fluidic switch means, said bistable fluidic switch means having a diverging-converging reversing chamber in which the pressure is always greater than any downstream pressure, and a power nozzle supplying liquid under pressure from a liquid supply to said diverging-converging reversing chamber and then through a common outlet to at least a pair of output channels, means for converting electronic control signals from said computer to fluid signals for controlling the switched state of said fluidic switch element, a first output channel connected to said common outlet for delivering liquid to said utilization system when said bistable fluidic switch is in one of its bistable states, a second output connected to said common outlet constituting a return to said liquid supply when said bistable fluidic switch is in the other of its bistable states, and means controlled by said electronic control signals for controlling said means for converting to switch the states of said bistable fluidic switch element and control the amount of liquid flow to said first channel and said utilization system.

2. The liquid metering apparatus defined in claim 1 wherein said bistable fluidic switch has a pair of control ports connected to said diverging-converging reversing chamber adjacent said power nozzle and, a channel member having a hollow channel therein for receiving a portion of the liquid being metered, said means for converting including a movable magnetically controlled member secured to said hollow channel member for actuating said movable magnetically controlled member by signals from said computer, and means connecting fluid pulse signals induced in the liquid in said hollow channel member upon movement thereof to said control ports, respectively.

3. The liquid metering apparatus defined in claim 1 wherein said diverging-converging reversing chamber includes a pair of control ports adjacent said power nozzle, a pair of openings downstream of the diverging portions of said diverging-converging reversing chamber, and a pair of passageways interconnecting said control ports with said openings in said sidewalls, respectively, and means responsive to said electronic signals for inducing simultaneous movement of a portion of each of said pair of passageways to cause a switch of liquid flow in said bistable fluidic switch means.

4. The liquid metering system defined in claim 1 wherein said means for converting said electronic signals to fluidic signals is selected from the group consisting of magnetic and piezoelectric controlled elements.

5. The liquid metering system defined in claim 1 wherein said diverging-converging reversing chamber is defined by sidewalls converging to said common outlet from said chamber such that liquid flow fills said common outlet so that the body of liquid flow therethrough isolates said chamber from downstream pressure conditions.

6. In a fuel control system for an internal combustion engine wherein liquid fuel is supplied to the engine from a liquid fuel supply through at least one fluidic control element having a first output channel leading to said engine and a second output channel returning liquid fuel to said fuel supply, said computer means having means for sensing a plurality of engine operating criteria and computing therefrom an optimum fuel flow rate for said engine and producing an electrical signal corresponding to said optimum fuel flow rate, and means controlled by said electrical signal for producing a fluidic control signal, the improvement in said means producing said fluidic control signal comprising, the liquid metering apparatus defined in any of claims 1–5 wherein said liquid supply is constituted by said liquid fuel supply, said bistable fluidic switch is said fluidic control element, means connected to said bistable fluidic switch control element for converting said electronic signals to fluidic signals for controlling said bistable fluidic switch control element to switch the fuel between said first and second output channels.

7. The liquid metering system defined in claim 1 wherein said bistable fluidic switch element has an interaction region chamber of the type wherein the sidewalls first diverge from said power nozzle and then converge to a common outlet and which alternately feeds fluid to first one and then another output channel and liquid flow through said common outlet always fills said common outlet and isolates said chamber from said output channels and generates feedback signals for maintaining liquid flow to one of said at least a pair of output channels until switched by said electronic signal.

8. The liquid metering apparatus defined in claim 1 wherein said means for converting electronic control signals from said computer to fluid signals for controlling the switched state of said fluid switch element includes a permanent magnet having an air gap therein and a coil assembly movably mounted in said air gap, and means for connecting said electronic control signals to said coil assembly, at least one hollow tube filled with the liquid being metered, means connecting said hollow tube to said coil assembly for movement therewith, said bistable fluidic switch has at least one control port adjacent said power nozzle and at least one opening downstream of the diverging portion of said diverging-converging reversing chamber, and means coupling the ends of said at least one hollow tube to said control port and said at least one opening, respectively.

9. The liquid metering apparatus defined in claim 8 including a pair of flat spring members mounted on said magnet for supporting said coil assembly and at least one hollow tube therefrom at a predetermined position therein when said coil is not energized with an electronic control signal.

10. The liquid metering apparatus defined in claim 9 wherein there are a pair of said hollow tubes, said flat springs are E-shaped, means mounting the center leg of each said E-shaped spring members to each end of said magnet, and means mounting the respective ends of said tubes in the outer legs of said E-shaped spring.

11. An electrical signal to fluidic signal transducer comprising, a channel member having a hollow channel therein, a liquid in said hollow channel, means connected to said hollow channel member for receiving and converting said electrical signal to movement of said hollow channel member and generating differential in pressure in the liquid at the ends thereof, and means at the ends of said hollow channel member for applying the differential pressure generated at said ends by the response of the liquid in said hollow channel, as said channel member is moved, to a utilization device.

12. The electrical signal to fluidic signal transducer defined in claim 11 wherein said means for converting includes a magnetic coil connected to said hollow channel member and driven by said electronic signal for inducing an accelerating movement of said hollow channel member.

13. The electrical signal to fluidic signal transducer defined in claim 11 wherein said means for converting includes a piezoelectric element driven by said electronic signal.

14. A fuel control system for an internal combustion engine wherein fuel is supplied to the engine from a fuel supply through at least one fluid control element having a first output channel leading to said engine and a second output channel returning fuel to said fuel supply, electronic computer means for sensing a plurality of engine operating criteria and computing therefrom an optimum fuel flow rate for said engine and producing an electrical signal corresponding to said optimum fuel flow rate, and means for converting said electrical signal to a fluid control signal, the improvement wherein, said fluid control element is a bistable fluidic switch element, means responsive to said electronic signals to transduce said electrical signals to fluidic signals for controlling the on off states of said bistable fluidic switching control element to switch the fuel between said first and second output channels.

15. The control system defined in claim 14 wherein said outlet isolates said diverging-converging reversing chamber from said output channels, said diverging-converging chamber generating feedback signals for maintaining the fuel flow along said sidewalls until switched by said fluidic signal.

16. The fuel control system defined in claim 14 wherein said bistable fluidic switch element includes:

a pair of control ports upstream of said converging sidewalls, a pair of openings in said sidewalls downstream of said control ports, and a pair of passageways interconnecting said control ports with said openings in said sidewalls and means controlled by electrical signals from said on-board computer for creating a fluid pulse in alternate directions in said pair of passageways.

* * * * *